US005819994A

United States Patent [19]

Leipold

[11] Patent Number: 5,819,994

[45] Date of Patent: Oct. 13, 1998

[54] FLOW CONTROL CAP

[76] Inventor: Hermann Leipold, 1163 N. Hickory, Arlington Heights, Ill. 60004

[21] Appl. No.: 759,612

[22] Filed: Dec. 5, 1996

[51] Int. Cl.[6] ..... B65D 25/42

[52] U.S. Cl. ..... 222/541.9; 222/564; 222/569; 222/571

[58] Field of Search ..... 222/188, 454, 222/455, 456, 541.9, 564, 569, 571

[56] References Cited

U.S. PATENT DOCUMENTS

| | | | |
|---|---|---|---|
| 3,330,450 | 7/1967 | Clare | 222/564 X |
| 4,697,722 | 10/1987 | Saito et al. | 222/571 |
| 4,856,685 | 8/1989 | Gaffney | 222/564 X |
| 5,048,723 | 9/1991 | Seymour | 222/564 X |
| 5,123,575 | 6/1992 | Li | 222/564 |
| 5,356,053 | 10/1994 | Di Fatta | 222/456 |

*Primary Examiner*—Kenneth Bomberg
*Attorney, Agent, or Firm*—Niro, Scavone, Haller & Niro

[57] ABSTRACT

A flow controlling cap (20) for a fluid container (12) controls fluid flow by means of gravity and pressure, and has a first chamber (22) formed by a first hollow cylinder (22) and a second chamber (24) formed by a second hollow cylinder (24) having a greater diameter than the first hollow cylinder (22). The first cylinder (22) forms the part of the cap (20) that will fit into the interior of the bottle neck (46). A partition wall (36) between the two chambers (22, 24) sealingly contacts the radial surface of the bottle opening (46). The cap (20) structure has a plurality of holes (30, 40, 42) formed in it that are specifically positioned to use forces of gravity, static fluid pressure, ambient air pressure and fluid surface tension to control the timing of fluid release when a bottle (12), fitted with the cap (20), is moved from an upright to an inverted position.

4 Claims, 4 Drawing Sheets

FLOW CONTROL CAP

BACKGROUND OF INVENTION

1. Field of the Invention

The present invention relates to fluid flow control in the handling and dispensing of fluids and, more particularly, to a device for controlling fluid flow through the opening of a container.

2. Background of the Invention

Typical drinking water cooler dispenser stands are designed to be used with standard-sized, commercially available five-gallon water bottles. Such bottles, relatively large and heavy, are usually sealed with a disposable plastic cap after filling. They are transported from the filling center to the end user with the cap in place.

In normal use, the user will break the seal and remove the plastic cap immediately prior to installing the bottle on a commercial dispensing stand. A typical commercial dispensing stand comprises a holder for holding the opened bottle in an inverted position to enable complete draining of the bottle without the need for a pump or an external pressure source. Water draining out of the bottle is directed through the body of the holder to a selectively activated spout or nozzle to enable a user to controllably release water.

In order to position an opened water bottle in an inverted position for use with a typical commercial dispenser stand, a user must first remove the cap and lift the opened water bottle to the height of the bottle receiving portion of the stand, which typically exceeds three feet. Then the user must invert the bottle and place it into the receiving portion, positioning it so that the receiving portion forms a seal with the bottle exterior in order to prevent water leakage.

During the process of inverting the bottle and positioning it in the receiving portion of the stand there is often unavoidable spillage of the water from the bottle. Commercial five gallon water bottles have relatively large diameter openings. Such spillage makes it desirable for a user to swiftly invert and position the bottle. In addition to wetting of surfaces of the user's body, there is the danger that a person who is compelled to swiftly handle a large and heavy bottle may be injured or may damage the bottle or the cooler. In order to avoid the aforementioned problems associated with spillage and dangerous handling conditions, various attempts have been made to provide means for controlling water discharge from a water bottle so that careful handling and positioning of a water bottle in a dispensing stand can be carried out with little or no spillage.

Certain known devices include a stopper or cap having winding or nested channels to delay the discharge of water during tilting and inversion of the bottle by diverting its path. Such devices require complex and costly construction, or they lack positive and complete sealing means for a complete non-flow mode. Therefore, these types of devices are not suitable for use as disposable caps because they would require a second cap to provide sealing or they would be costly. Similarly, known devices that utilize ball or check valves are prohibitively costly or complex.

Other known devices comprise an attachment having a cap-piercing member and a conduit body. Such devices are prone to leakage where the cap-piercing member enters the cap of a water bottle and such devices are prohibitively complex in construction and are costly.

Still, other known devices employ specialized cap designs that are designed to physically cooperate with an activating or piercing member in the dispensing stand or bottle holder.

Such devices require complex cap construction and further require use of a specific type of dispensing stand equipped with activating or piercing members. Furthermore, the use of re-usable flow devices increase the risk of contamination of drinking water.

It is an object of the invention, therefore, to provide a flow control cap for a water bottle or similar fluid container that controls flow during tilt and inversion, that is practical to manufacture, and that can be quickly and easily implemented by the user. It is a further object to provide a device that can be used with a variety of types of dispensing stands. It is yet a further object to provide a device that can serve as a seal and as flow control means such that one cap can be used to seal at the time of filling and to control flow throughout the end use of the water bottle.

SUMMARY OF THE INVENTION

The present invention is directed to a flow controlling cap for a fluid container that utilizes a unique multiple chamber configuration and a plurality of holes positioned to control fluid flow by means of gravity and pressure.

In a preferred embodiment of the invention, the present invention comprises a water bottle cap having a first chamber formed by a first hollow cylinder and a second chamber formed by a second hollow cylinder having a greater diameter than the first hollow cylinder. The two cylinders are positioned with radial surfaces in contact so that they share a common interior wall or partition. The first cylinder forms the part of the cap that will fit into the interior of the bottle neck. The partition wall, having a diameter equal to the diameter of the second cylinder forms a flange that will contact the radial surface of the bottle opening. Since the bottle opening has a smaller diameter than the partition wall, the partition wall forms a sealing surface with the radial surface of the bottle opening. The second cylinder outer wall extends axially past the partition wall in the direction of the first cylinder to form a circumferential lip that fits over the outside surface of the bottle neck opening to form a tight fitting cap.

The cap structure comprising the two aforementioned cylinders has a plurality of holes formed in it. The holes are specifically positioned to use forces of gravity and static fluid pressure to control the timing of and amount of fluid release when a bottle, fitted with the cap, is moved from an upright to an inverted position.

In a preferred embodiment the first chamber has a first hole-positioned to permit water to begin entry therein upon tilting the bottle no later than when the bottle is positioned approximately 90 degrees from an upright position. The partition wall has a second hole positioned at a lower, middle location when the partition is in a vertical plane. The outer radial wall of the second cylinder, generally parallel to the partition, has a third hole positioned diametrically opposite of the second hole, or at a top middle position when the outer wall is in a vertical plane.

As the bottle is tilted, water begins to fill the first chamber via the first hole. Water begins to nearly simultaneously fill the second chamber via a second hole. At approximately 90 degrees of tilt the first hole will be completely submerged in water and the first chamber will be substantially filled with water. This condition occurs prior to the water level in the second chamber rising to the level of third hole. When the water level in the second chamber rises past the second hole the water surface in the second chamber forms a meniscus between the outer wall and the partition, bordered by the inner circumferential wall of the second chamber.

The meniscus will remain at a generally constant level below the third hole and water will be prevented from escaping the bottle until the bottle is further tilted so that the second and third holes are generally aligned in a horizontal plane. At that point, water is only trickled out until the bottle has been fully inverted for a few seconds. This behavior of the water is attributable to a pressure balance between the ambient air pressure outside the cap and the inner water pressure in the second chamber.

Prior to the horizontal aligning of the second and third holes, essentially no water is discharged. Because the second hole is lower than the third hole, and the first and second chambers are sealed by water pressure from within the bottle, a vacuum effect prevents water from being forced out of the bottle. In order for water to discharge from the bottle, ambient air must be allowed to enter and displace water in one of the chambers or the bottle. The only path such ambient air could take in order to enter a chamber and displace water is between the second and third holes. Because the ambient pressure is less than the water pressure in the bottle, the ambient air will not travel downward from the third hole to the second hole and into one of the chambers. Thus, water cannot be displaced and the vacuum effect results.

When the bottle is tilted to a position in which the second and third holes are generally aligned in a horizontal plane, the water surface in the second chamber dips below the second hole, enabling outside air to enter the first chamber and immediately float upward, escaping through the first hole and into the water bottle. This breaks the vacuum seal and allows sufficient discharge to establish water flow out of the bottle. The hole diameters and chamber dimensions are selected to optimize the rate of initial and final water flow.

In one particular embodiment of the present invention, a removable seal is provided over the third hole such that a liquid container can be fitted with a flow control cap of the present invention having a liquid-tight seal that will prevent escape of liquid from the container until the seal is selectively removed therefrom. The removable seal can be a disposable tear-away type of seal that can be removed when it is desirable to establish flow of the liquid from the container.

DESCRIPTION OF THE PREFERRED EMBODIMENTS

Figure 1:
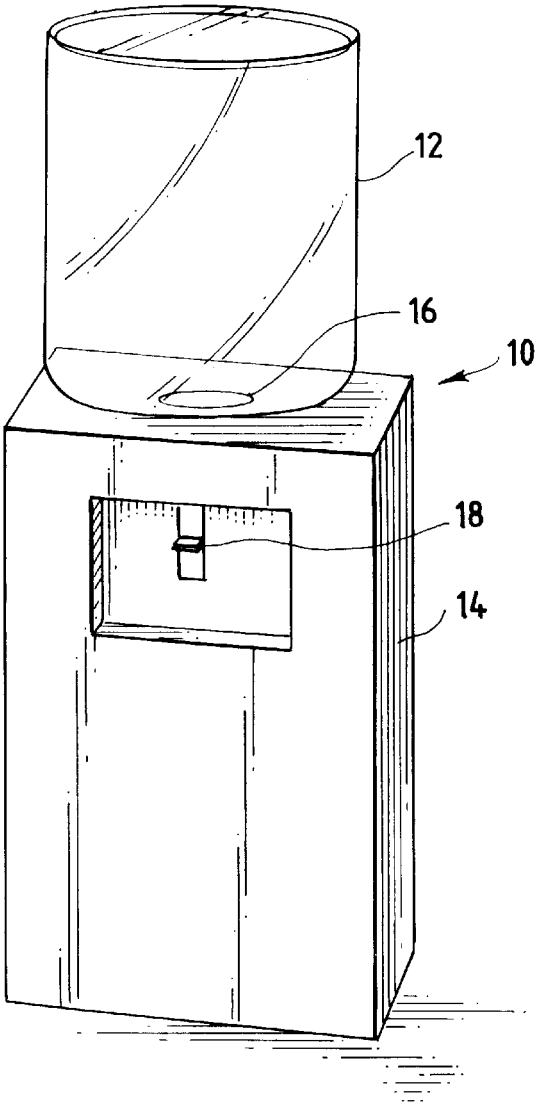
FIG. 1 illustrates a typical water stand for bottled water and a water bottle mounted thereon.

In FIG. 1 a typical water bottle and dispenser stand arrangement (10) is illustrated. The arrangement comprises a water bottle (12) inverted and mounted on a dispenser base (14) in sealing contact with a sealed rim (16). The exterior of the bottle (12) contacts the rim (16) and creates a seal by the force of gravity applied to the mass of the bottle (12). The rim (16) defines an internal opening (not shown) in the dispenser base (16) which communicates with one or more spouts (18) adapted to selectively discharge water.

Figure 2:
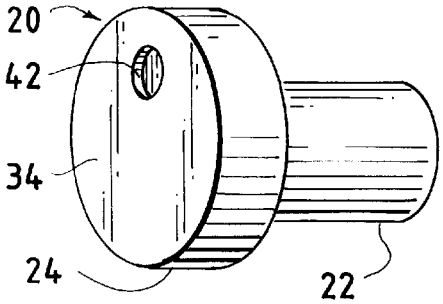
FIG. 2 illustrates a first perspective view of a first embodiment of the present invention liquid container flow control cap.
Figure 3:
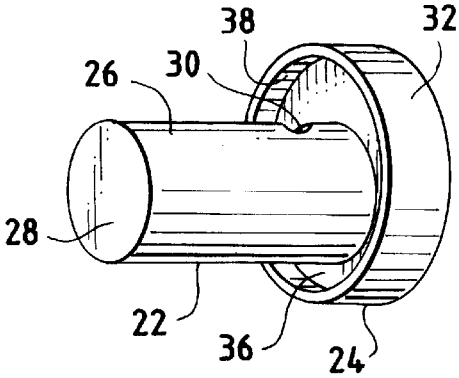
FIG. 3 illustrates a second perspective view of the cap of FIG. 2.
Figure 4:
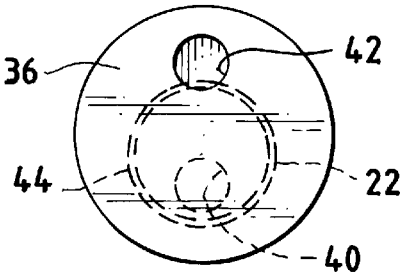
FIG. 4 is a partial rear view of the partition wall of the cap of FIG. 2.

A flow control cap (20) of the present invention is illustrated in FIGS. 2 and 3. The cap (20) is comprised of two basic sections, a first hollow cylinder (22) and a second hollow cylinder (24). The first cylinder (22) comprises an outer circumferential surface (26) and a first radial surface (28). A first hole (30) in communication with the hollow interior of the first cylinder (22) is provided on the circumferential surface (26). The second cylinder (24) comprises an outer circumferential surface (32) and a second radial surface (34). The first and second cylinders (22, 24) are joined at and share a radial surface interior wall, or partition (36). The second cylinder (24) further comprises a flexible lip (38) and a third hole (42). A second hole (40) is provided on the partition (36) as illustrated in FIG. 4. The second hole (40) is positioned on the partition (36), as shown in FIG. 4, such that it is received within the area enclosed by the circumference (44) of the first cylinder (22) as shown in phantom.

Figure 5:
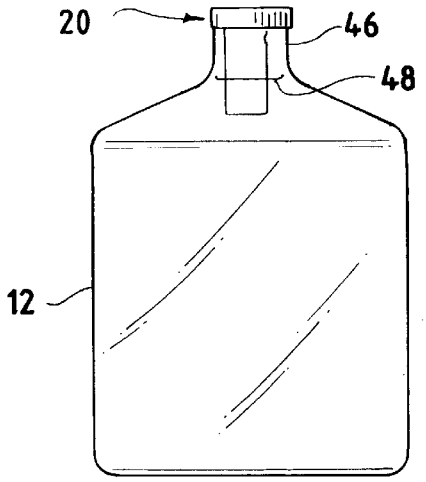
FIG. 5 illustrates the cap of FIG. 2 installed in a conventional water bottle.
Figure 6:
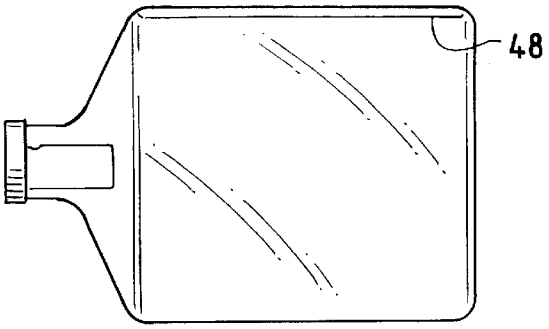
FIG. 6 illustrates the cap and bottle assembly of FIG. 5 in a horizontal position.
Figure 7:
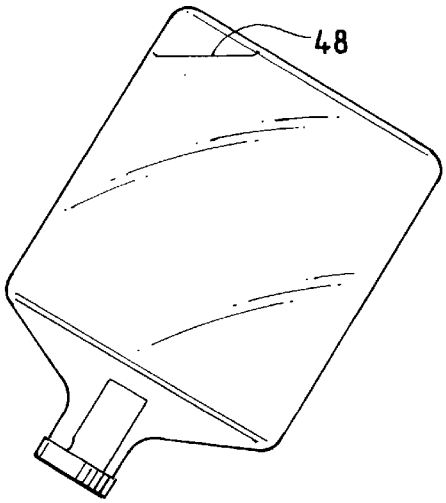
FIG. 7 illustrates the cap and bottle assembly of FIG. 5 in a tilted position approaching a vertical position.

The cap (20) is designed to fit over the neck opening (46) of a bottle (12) or container as shown in FIG. 5. The water level (48) illustrated in FIGS. 5–7 is intended to illustrate a full bottle level. The lip (38) is of sufficient flexibility to press fit over the neck (12) and form a seal therewith. In the preferred embodiment, the entire cap can be fabricated from a single flexible material such as a thermoplastic or other suitable material. The holes (30, 40, 42) are aligned in such a way to control the timing and the flow of fluid and to create pressure forces as described below.

The partition wall (36), having a diameter equal to the diameter of the second cylinder (24) and greater than the bottle opening (46), forms a flange that will contact the radial surface of the bottle opening (46) as the lips (38) fit tightly around the exterior of the bottle opening (46) to form a seal therewith as shown in FIG. 5.

Figure 8:
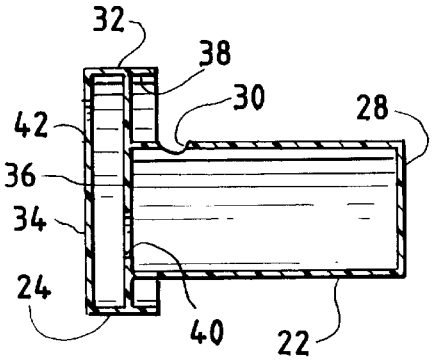
FIG. 8 illustrates a side cross-sectional view of the cap of FIG. 2.
Figure 9:
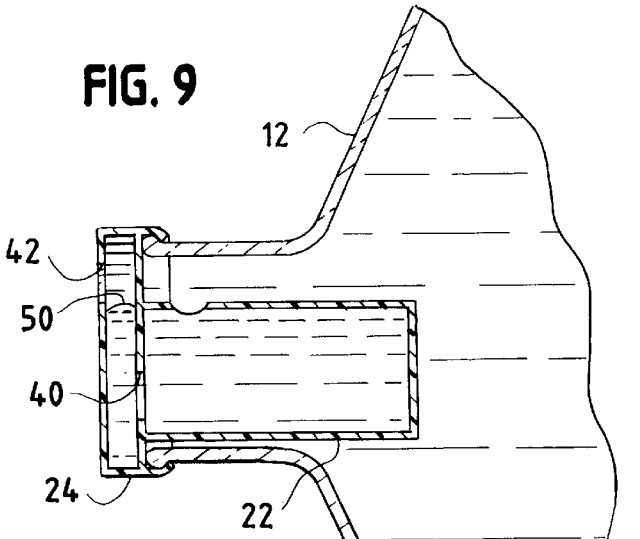
FIG. 9 illustrates a side cross-sectional view of the cap and bottle assembly of FIG. 5.
Figure 10:
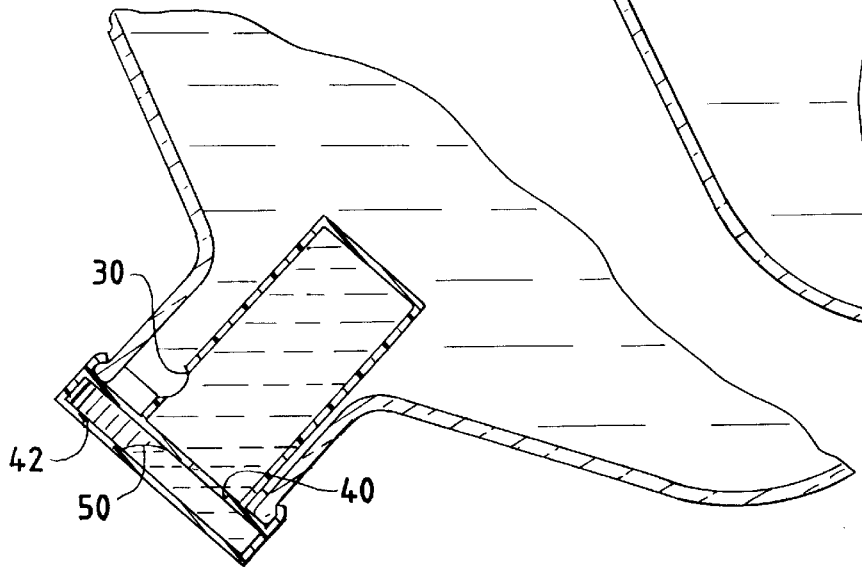
FIG. 10 illustrates a side cross-sectional view of the cap and bottle assembly of FIG. 5 in a tilted position approaching a vertical position.
Figure 11:
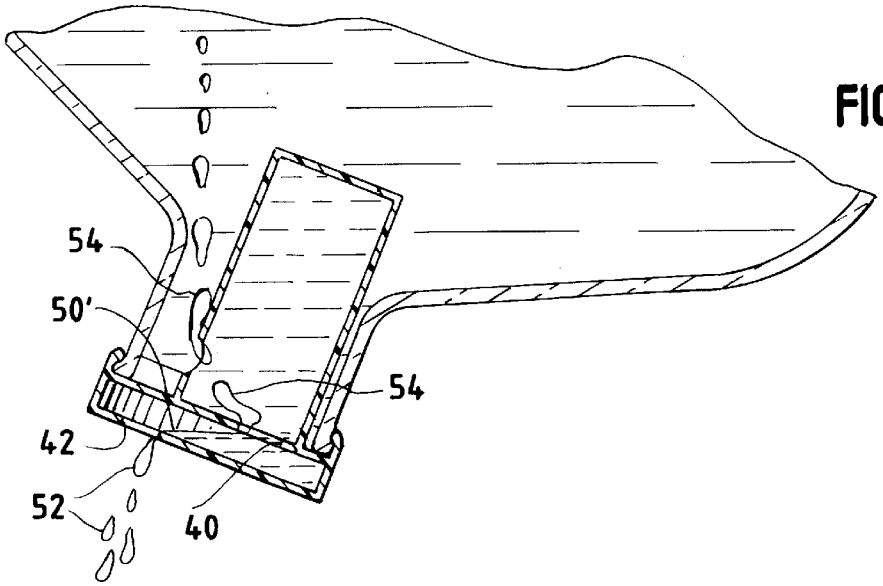
FIG. 11 illustrates a side cross-sectional view of the cap and bottle assembly of FIG. 5 in a further tilted position approaching a vertical position.
Figure 12:
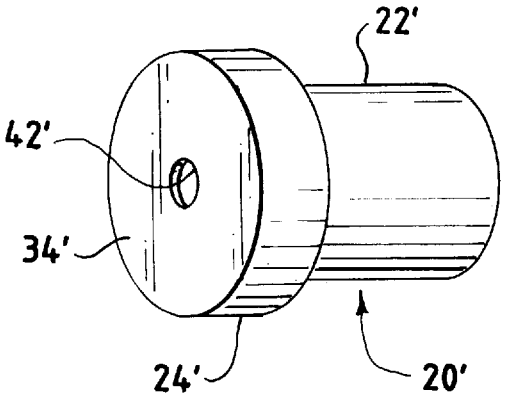
FIG. 12 illustrates a first perspective view of a second embodiment of the present invention liquid container flow control cap.

A cross-sectional side view of the cap (20) of the present invention is illustrated in FIG. 8, and is illustrated assembled to a bottle (12) in FIGS. 9–11.

The interior of the first cylinder (22) defines a chamber whereby the first hole (30) is positioned to permit water to begin entry therein upon tilting the bottle (12) no later than when the bottle (12) is positioned approximately 90 degrees from an upright position as shown in FIG. 6 and in corresponding FIG. 9. For operation of the embodiment of FIGS. 2–11, it is required that the cap (20) be angularly oriented with the third hole (42) at approximately the top of the cap (20) or the "twelve o'clock" position when the bottle (12) is tilted horizontally. For optimum performance, such orientation of the cap (20) should remain and tilting should continue in generally the same approximate vertical plane. Preferably, the first hole (30) is positioned at a greater vertical height than the lowest point in the first chamber (22) when the bottle (12) and cap (20) are tilted in the horizontal position of FIGS. 6 and 9. The second hole (40) is positioned at a lower, middle location of the partition (36) when the partition (36) is in a generally vertical plane. The third hole (42) is positioned diametrically opposite of the second hole (40), or at a top middle position of the second radial wall (34), when the second wall (34) is in a generally vertical plane. At approximately 90 degrees of tilt the first hole (30) will be completely submerged in water and the first chamber defined by the first cylinder (22) will be substantially filled with water. This condition occurs prior to the water level in the second cylinder (24) rising to the level of third hole (42).

As the bottle (20) is further tilted as shown in FIG. 7 and corresponding FIG. 10 toward a vertical position for placement in a dispenser stand, water begins to fill the first chamber defined by the first cylinder (22) via the first hole (30). Water begins to nearly simultaneously fill the second chamber defined by the second cylinder (24) via the second hole (40). When the water level in the second cylinder (24) rises past the second hole (40), the water surface in the second cylinder (24) forms a meniscus (50) between the second wall (34) and the partition (36), bordered by the inner surface of the circumferential wall (32) of the second cylinder (24).

The meniscus (50) will remain at a generally constant level below the third hole (42) and water will be prevented from escaping the bottle (12) and cap (20) until the bottle (12) is further tilted past the horizontal to a point where the second and third holes (40, 42) are generally aligned in a horizontal plane, as shown in FIG. 11. At that point, water (52) is only trickled out as it is displaced by air (54) when the meniscus seal is broken (50'). More rapid flow is established after the bottle (12) has been fully inverted for a few seconds. This behavior of the water is attributable to a pressure balance between the ambient air pressure outside the cap (20) and the inner water pressure in the cap (20) and bottle (12).

Prior to the horizontal aligning of the second and third holes (40, 42), essentially no water (52) is discharged. Because the second hole (40) is lower than the third hole (42), and the first and second chambers (22, 24) are sealed by water pressure from within the bottle (12), a vacuum effect prevents water from being forced out of the bottle. In order for water (52) to discharge from the bottle (12), ambient air must be allowed to enter and displace water in one of the chambers or the bottle. The only path such ambient air could take in order to enter a chamber and displace water is between the second and third holes (40, 42). Because the ambient pressure is less than the water pressure in the bottle (12), the ambient air will not travel downward from the third hole (42) to the second hole (40) and into one of the chambers (22, 24). Thus, water cannot be displaced and the vacuum effect results.

When the bottle (12) is tilted to a position in which the second and third holes (40, 42) are generally aligned in a horizontal plane as shown in FIG. 11, the water surface (50') in the second chamber (24) dips below the second hole (42), enabling outside air (54) to enter the first chamber and immediately float upward, escaping through the first hole and into the water bottle (12). This breaks the vacuum seal of the meniscus (50) and allows sufficient discharge to establish water flow (52) out of the bottle (12).

The hole diameters and chamber dimensions are selected to optimize the rate and timing of initial and final discharge. Through experimentation the inventor has determined that hole diameters of approximately ½ inch for each of the first, second and third holes (30, 40, 42) provide optimum performance when used with a bottle opening of approximately 2 inches and first and second cylinders (22, 24) of dimensions approximately 2 inch diameter by ½ inch height and 1.2 inch diameter by 2 inch height, respectively.

A second embodiment of the present invention is disclosed in FIGS. 12–15. The second embodiment is directed to a cap (20') that is similar to the cap (20) of FIGS. 2–11, except that it is configured to by omni-directional. The cap (20') is configured to function regardless of how the cap (20') is angularly oriented relative to the plane of tilt of the bottle.

Figure 13:
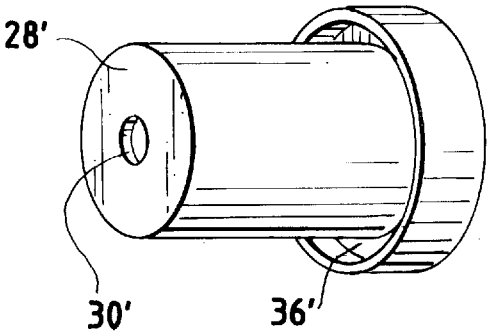
FIG. 13 illustrates a second perspective view of the cap of FIG. 12.
Figure 14:
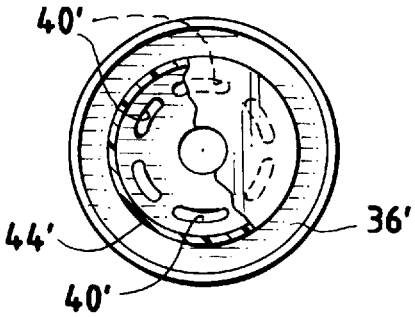
FIG. 14 illustrates a partial rear view of the partition wall of the cap of FIG. 12.

The cap (20') of the second embodiment comprises a first hollow cylinder (22') and a second hollow cylinder (24'). The cylinders (22', 24') are dimensioned and structurally joined in a similar manner as the cylinders (22, 24) in the embodiment of FIGS. 2–11. A partition (36') separates first and second chambers formed by the cylinders (22', 24'). A first hole (30') is provided on the first radial wall (28') of the first cylinder (22'). The first hole (30') is positioned generally concentrically with respect to the first radial wall (28') as shown in FIG. 13. The partition (36'), illustrated in FIG. 14, is provided with a series of second holes (40') that are distributed at various angular locations near the perimeter of the partition (36'). The second holes (40') are located within the circumference of the first cylinder (22') represented in FIG. 14 by the phantom line (44'). A third hole (42') is located in a generally concentric position on the second radial wall (34') of the second cylinder (24').

Figure 15:
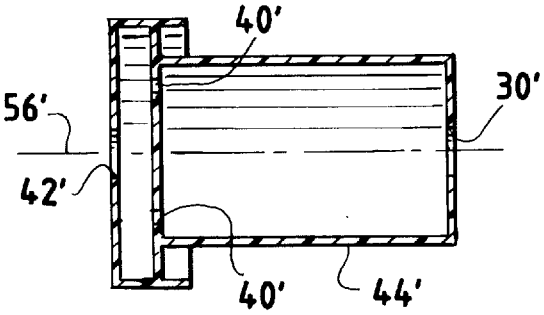
FIG. 15 illustrates a side cross-sectional view of the cap of FIG. 12.

A cross-sectional view of the cap (20') of the second embodiment is depicted in FIG. 15. As shown, first and third holes (30', 42') are approximately coaxially aligned with a center line (56') that generally defines a longitudinal axis through the first and second cylinders (22', 24'). The second holes (40') are positioned radially outward from the first and third holes (30', 42').

In operation, the cap (20') of the second embodiment performs essentially that same way of the cap (20) of the first embodiment. When the capped bottle approaches the horizontal position, water enters the first cylinder (22') through the first hole (30') and begins to pass through the second hole or holes (40') positioned at a lowermost position and into the second chamber (24') when the partition (36') is in a generally vertical plane. The water level in the second cylinder (24') will rise to a point below the third hole (42') and form a meniscus between the interior surfaces of the second radial wall (34') and the partition (36'). Although some ambient air will be permitted to pass through the uppermost second hole (40') and into the first cylinder (22'), a slight vacuum seal will be formed due to the prevention of ambient air passing through the first hole (30') and into the bottle by water pressure from within the bottle. A small accumulation of ambient air will fill the upper area of the first cylinder (22'). As the bottle is tilted past the horizontal and toward an inverted position, the water surface in the first chamber will fall to the level of the first hole (30'), at which point ambient air will enter the bottle interior. When this occurs the water will begin to trickle and eventually flow out of the bottle and cap (20') as the bottle is fully inverted.

Figure 16:
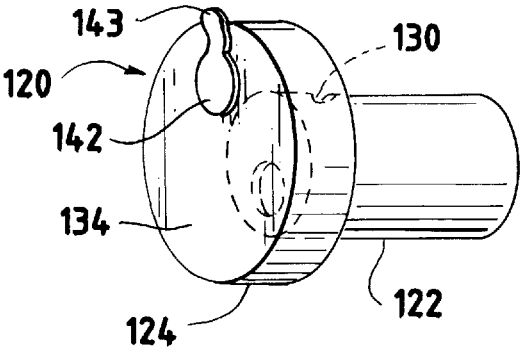
FIG. 16 illustrates a perspective view of a second embodiment of the present invention liquid container flow control cap.

An alternative embodiment of the present invention flow control cap (120) is illustrated in FIG. 16. The cap (120) is essentially similar to the cap (20) of FIGS. 2–11, except that the cap (120) is provided with a removable seal (142). The removable seal (142) can be of a variety of forms in which the seal (142) will prevent liquid from escaping the container or bottle (12), yet the seal (142) can be selectively removed and discarded to establish flow from the container (12). In the preferred embodiment, the seal (142) is in the form of a scored outline of the third hole (42) of FIG. 2, and has a tab (143) that can be grasped by a person's fingers and torn away from the second radial wall (134). It is understood that the removable seal (143) can take different forms, including those used in analogous settings such as sealing of liquid grocery products. For example, the removable seal (142) can also be in the form of a foil or combination foil and plastic membrane (not shown).

While the foregoing description and drawing figures are directed to the preferred embodiments, it is acknowledged that various modification can be made to these embodiments without departing from the scope of the claimed invention.

What is claimed is:

1. A flow control device for controlling the discharge of a fluid from a container comprising a cap having a body and being adapted to sealingly engage an opening on said container, said body having two chambers, one of which is a first chamber and a one of which is a second chamber, wherein said first and second chambers are joined together;

a first hole in said first chamber communicating with the interior of said container;

a second hole in said first chamber communicating with the interior of said second chamber;

a third hole in said second chamber communicating with the environment outside of said container;

whereby said second and third holes are centered about axes that are generally parallel to each other, each being generally aligned along a first direction, and said first hole is aligned generally perpendicularly to said first direction, such that when said container is tilted approximately 90 degrees from a vertical position a fluid contained in said container will first enter the first chamber through the first hole, and then enter the second chamber through the second hole, and will exit the third hole into the environment outside of said container after said container is tilted past approximately 90 degrees from a vertical position.

2. A flow control device according to claim 1, further comprising selectively removable sealing means for sealing said third hole.

3. A flow control device for controlling the discharge of a fluid from a container, comprising a first generally cylindrical hollow body of a first diameter having a first radial wall, a second radial wall, a circumferential wall of a first length, a first hole positioned on the first radial wall generally concentrically with respect to said first radial wall, and a plurality of holes positioned on said second radial wall at angular positions generally evenly spaced around a complete circle;

a second generally cylindrical hollow body of a second diameter that is less than said first diameter having a first radial wall at a first end, a circumferential wall, and a third hole positioned on said first radial wall generally concentrically with respect to said second body, whereby a second end of said second body is joined to said first body at said second radial wall of said first body such that said third hole is positioned concentrically within said plurality of holes on said first body and such that said plurality of holes on said first body are enclosed within said second diameter.

4. A flow device according to claim 3, further comprising selectively removable sealing means for sealing said first hole.

* * * * *